United States Patent [19]

Arad

[11] Patent Number: 4,512,328

[45] Date of Patent: Apr. 23, 1985

[54] PORTABLE GAS HEATER PARTICULARLY USEFUL FOR HEATING FOODSTUFFS

[76] Inventor: Yoel Arad, Kibbutz Kfar Blum, D.N., Galil Elyon, Israel

[21] Appl. No.: 529,641

[22] Filed: Sep. 6, 1983

Related U.S. Application Data

[63] Continuation-in-part of Ser. No. 253,661, Apr. 14, 1981, abandoned.

[30] Foreign Application Priority Data

Apr. 29, 1983 [IL] Israel ..... 68528

[51] Int. Cl.[3] ..... F24C 15/10

[52] U.S. Cl. ..... 126/37 B; 126/37 R; 126/52; 126/261; 126/262; 126/265; 99/483

[58] Field of Search ..... 126/37 R, 37 B, 39 M, 126/48, 49, 50, 246, 256, 252, 258, 260, 267, 262, 268, 266, 265, 261; 99/339, 483

[56] References Cited

U.S. PATENT DOCUMENTS

| | | | |
|---|---|---|---|
| 427,129 | 5/1890 | Stewart | 126/39 R |
| 864,508 | 8/1907 | Buhtmann | 126/39 F |
| 1,545,393 | 7/1925 | Bryant | 126/265 |
| 1,888,888 | 11/1932 | Rudoy | 126/50 |
| 2,678,644 | 5/1954 | Banks et al. | 126/261 |
| 4,122,764 | 10/1978 | D'Ambra | 126/265 X |
| 4,191,173 | 3/1980 | Dedeian et al. | 126/265 X |
| 4,196,721 | 4/1980 | Posnansky | 126/451 |

*Primary Examiner*—Larry Jones

*Attorney, Agent, or Firm*—Welsh & Katz, Ltd.

[57] ABSTRACT

A portable gas heater particularly useful for heating foodstuffs under all-weather conditions comprises a housing having a first section defining a gas burner compartment, and a second section defining a gas container compartment, the latter section including a pair of side walls hingedly mounted to a closed position closing the container compartment, or to an open position opening the container compartment and providing a stable support for the gas heater. The gas burner further includes a burner plate connected to the gas burner nozzle by means of a plurality of telescoping tubes to enable the burner plate to be positioned either at the lower end or the upper end of the gas burner compartment for accommodating different types of vessels.

29 Claims, 5 Drawing Figures

PORTABLE GAS HEATER PARTICULARLY USEFUL FOR HEATING FOODSTUFFS

RELATED APPLICATION

This application is a continuation-in-part of application Ser. No. 253,661 of Apr. 14, 1981, now abandoned.

BACKGROUND OF THE INVENTION

The present invention relates to portable gas heaters. The invention is particularly useful for heating foodstuffs, and is therefore described below with respect to this application.

A number of portable gas heaters for heating foodstuff have been devised. Most of them, however, expose the gas flame exteriorly of the housing, and therefore can be used only under limited conditions, e.g., when there is no fire hazard because of the exposed flame or when the flame would not be extinguished by wind, rain or snow. Other known types of portable gas heaters are relatively bulky and therefore inconvenient to carry, or do not provide sufficient heating of the foodstuff, or are not compatible with various types of food containers, e.g. narrow deep vessels such as cups or glasses, as well large vessels such as pans and pots.

An object of the present invention is to provide a portable gas heater particularly useful for heating foodstuff and having advantages in one or more of the above respects.

SUMMARY OF THE INVENTION

According to one broad aspect of the present invention there is provided a portable gas heater particularly useful for heating foodstuffs, comprising a housing including a first section defining a gas burner compartment, and a second section defining a gas container compartment; the second section of the housing including a pair of side walls hingedly mounted at one end along vertical axes, such that their opposite ends may be pivoted towards each other to a closed position to close the gas container compartment, or to an open position to open the gas container; the bottom of the pair of side walls, when in their open positions, being engageable with a surface supporting the portable gas heater to provide a stable support therefor during use.

According to another feature of the present invention, the gas burner compartment includes a gas burner chamber defined by a cylindrical wall inwardly spaced from said first section of the housing to provide an air passage therebetween, and a gas burner including a nozzle fixed at the lower end of the gas burner compartment, a burner plate overlying the nozzle, and a duct for conducting the combustible gas from the nozzle to the underface of the burner plate; the duct being constituted of a plurality of telescoping tubes to enable the gas burner plate to be positioned either at the lower end of the gas burner chamber for accommodating a food-containing vessel, or at the upper end of the gas burner chamber to enable the heater also to be used for heating other food-containing vessels supported at the top of the gas burner chamber.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
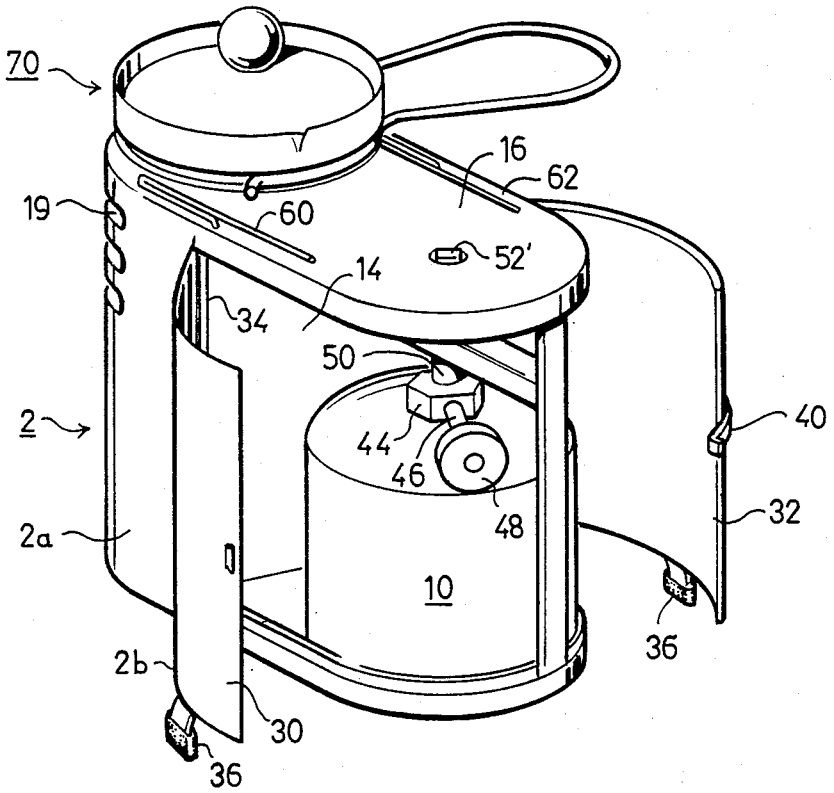
FIG. 1 is a three-dimensional view illustrating one form of portable gas heater constructed in accordance with the invention.

The portable gas heaters illustrated in the drawings is particularly useful for heating foodstuff under all-weather conditions or when an exposed flame may present a fire hazard or may otherwise be undesirable.

The illustrated gas heater comprises a housing, generally designated 2, divided into two main sections, namely a first section 2*a* defining a gas burner compartment 4 for receiving a gas burner assembly 6, and a second section 2*b* defining a gas container compartment 8 for receiving a gas-supply container 10 of a pressurized gas to be supplied via a feeding tube 12 to the gas burner assembly 6. The two compartments 4 and 8 are in side-by-side relationship, and are separated from each other by a partition wall 14. Housing 2 further includes a bottom wall 15 and a top wall 16 each common to both compartments.

A cylindrical wall 18 is fixed within the upper end of the gas burner compartment 4 slightly spaced inwardly from the inner face of the respective section 2*a* of the housing to provide an air passage. This section of the housing is formed with openings 19 to permit the entry of air into this passage.

The gas burner assembly 6 includes a nozzle 20 fixed at the lower end of the gas burner compartment, a burner plate 22, and a duct 24 for conducting the combustible gas from the nozzle to the underface of the burner plate where the gas is mixed with air entering the housing via openings 19 and passing through the space between cylindrical wall 18 and the housing.

Figure 4:
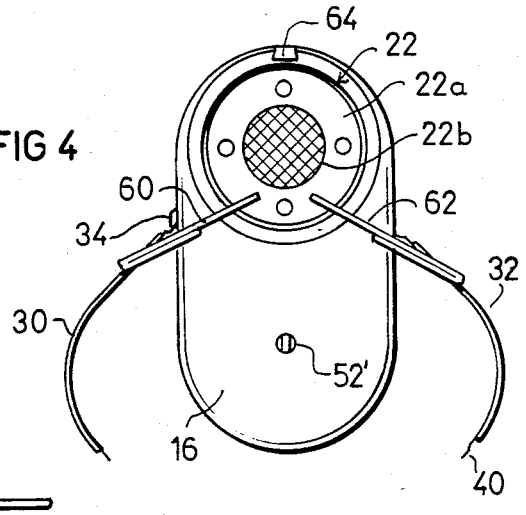
FIG. 4 is a top plane view of the heater in its open position.

As shown particularly in FIG. 4, burner plate 22 includes an outer annular ring 22*a* and an inner metal screen 22*b*. The flame is produced at the upper face of screen 22*b*. Ring 22*a* may be formed with a plurality of drain openings 22*c* to permit draining of any liquid that may be deposited on the ring.

Figure 2:
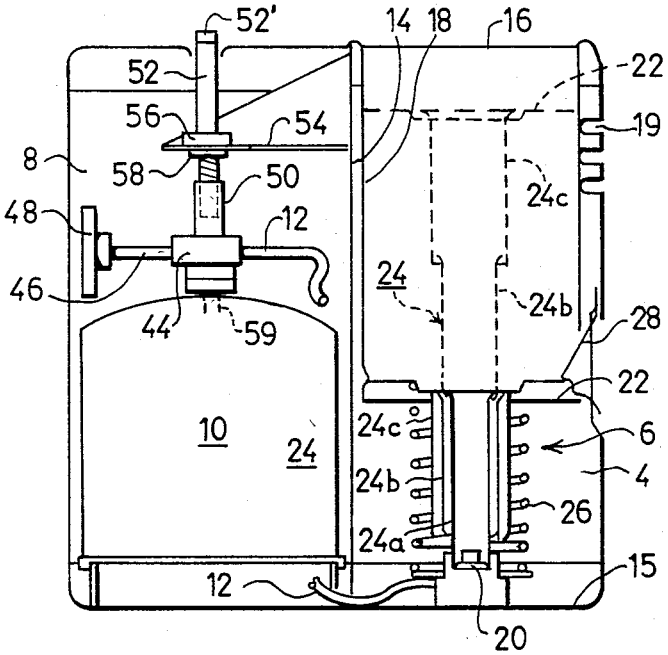
FIG. 2 is a side elevational view illustrating the interior of the housing of the heater, and particularly showing the lower position (full lines) and upper position (broken lines) of the burner plate in the gas burner chamber of the heater.
Figure 3:
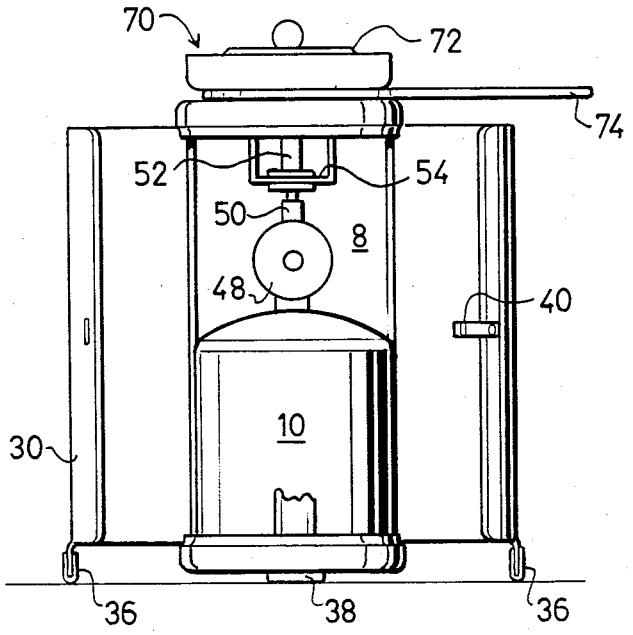
FIG. 3 is a front elevational view illustrating the heater of FIGS. 1 and 2 with the side walls of the gas container compartment in their open position during use of the heater.
Figure 5:
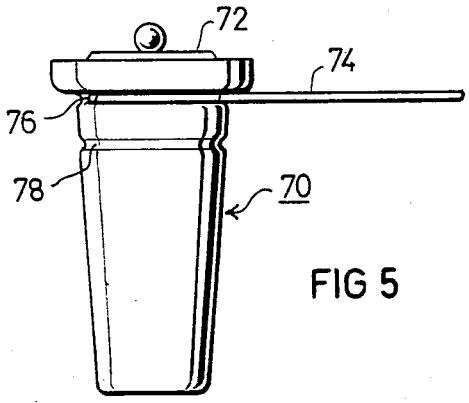
FIG. 5 illustrates a food-container vessel that may be used with the heater of FIGS. 1–4.

The illustrated heater accommodates different types of vessels for heating foodstuffs, such as a narrow deep vessel as illustrated at 70 in FIGS. 1, 3 and 5 for heating liquids, or a larger vessel such as a frying pan or pot (not shown). For this purpose, the burner plate 22 is movable to a lower position as illustrated in full lines in FIG. 2, or to an upper position as illustrated in broken lines in FIG. 2. To enable this alternative positioning of the burner plate 22, duct 24 is made of three telescoping tubes, namely a lower tube 24*a* fixed to the burner nozzle 20 and extending above it, and upper tube 24*b* fixed to the burner plate 22 and depending below it, and an intermediate tube 24*c* telescopingly coupling the other two tubes. The burner plate 22 is urged to its upper (broken-line) position by means of a coil spring 26 interposed between the burner plate and the bottom of the burner housing, but the plate may be releasably retained in its lower position by a retainer clip 28 passing through an opening in the housing section 2*a* below the inner cylindrical wall 14 of the burner chamber.

Housing section 2*b* defining the gas container compartment 8 includes a pair of curved side walls 30, 32 hingedly mounted to housing section 2*a* by vertically-extending hinges 34 such that the opposite ends of the side walls may be pivoted towards each other to a closed position to close the gas container compartment 8, or to an open position (as shown in FIGS. 1, 3 and 4) opening the gas container compartment. The two curved side walls 30, 32 include feet 36 projecting from their bottoms which feet engage the ground (or other horizontal surface) and provide a stable three-point support for the portable gas heater in cooperation with a third foot 38 (FIG. 3) carried at the bottom of housing section 2*a* defining the gas burner compartment 4. The two side walls 30, 32 are retained in their closed positions by a retainer clip 40.

The gas-supply container 10 includes an outlet fitting 44 to which the gas burner nozzle 20 is connected via the feed tube 12. A threaded pin 46 received within fitting 44 may be rotated by a knob 48 to vary the rate the gas is outletted from the container to its feed tube 12.

The gas-supply container 10 is normally sealed at the filling station, which seal must be broken when the container is first to be used. For this purpose, the outlet fiting 44 of the gas container 10 is provided with an upstanding sleeve 50 receiving a threaded pin 52. Pin 52 passes through an opening formed in plate 54 fixed to the housing 2. A ring 56 is fixed to pin 52 to overly the upper face of plate 54, and a removable snap-ring 58 is applied to pin 52 to underly the lower face of plate 54. The upper end of pin 52 passes through an opening in the top wall 16 of the housing so as to permit the pin to be manually rotated. The lower end of pin 52 is pointed, as shown at 59, such that rotation of the pin will cause its lower pointed end 59 to puncture the seal in the gas-supply container 10.

Preferably, knob 48, used for rotating pin 46 in order to adjust the gas output rate, is detachable from pin 46 and is attachable to pin 52 when it is desired to rotate the latter pin in order to puncture the seal in the gas-supply container 10. The end 52' of pin 52 projecting through the top wall of the housing is therefor flattened in order to key to knob 48 when received on the end of the pin for rotating same.

The gas heater further includes a pair of feet 60, 62 formed at the end of rods passing through the top wall 58 of the heater housing 2. Feet 60, 62 may be turned to an inoperative position, as illustrated in FIG. 1, or to an operative position as illustrated in FIG. 4 wherein they overlay the top of the burner plate 22 in the gas burner compartment 4. In the latter operative position, the two feet 60, 62 cooperate with a third foot 64 (FIG. 4) fixed at the upper end of the housing top wall 16 for supporting a pan or pot or other vessel over the supporting plate 22.

For use with the portable heater is a cup 70, or other narrow, deep vessel, as illustrated in FIG. 5. Cup 70 is preferably of conical configuration, being wider in diameter at the top than at the bottom, and includes a cover 72 closing its top. The cup further includes a wire handle 74 which is selectively receivable in either one of two annular recesses 76, 78 formed in the upper portion of the cup.

The portable gas burner illustrated in the drawings may be used in the following manner.

First, when inserting a fresh gas-supply container 10, the container is introduced into compartment 8, and the gas feed tube 12 is connected to the outlet fitting 44 of the container. Knob 48 is then inserted into the upper end 52' of the pin 52 projecting through the top wall 16 of the burner housing, and the knob is rotated to rotate pin 52 until its lower pointed end 59 pierces the seal in the container. Knob 48 is then removed from pin 52 and placed on pin 46 at the side of the outlet fitting 44. It may thereafter be used in turning on the gas-supply to the burner assembly 4 via the outlet fitting 44, and in regulating the rate at which the gas is supplied to the burner assembly.

The illustrated gas heater may be used for heating a liquid (in which case cup 70 is used) or any other foodstuff (e.g., eggs, etc., in which case a conventional pan or pot may be used). When a conventional pan or pot is used, retainer clip 28 is finger-pressed in order to release the burner plate 22, whereupon the burner plate rises, under the influence of spring 26, to its upper position shown in broken lines in FIG. 2. In this position, it is slightly below the top wall 16 of the housing, and is connected to the burner nozzle 20 by means of the telescoping tubes 24*a*, 24*b*, 24*c* providing a duct for transmitting the combustible gas from nozzle 20 to the burner plate 22 where the flame is produced, the air being supplied via openings 19 and the space between the housing and the inner wall 18. Feet 60, 62 may then be pivoted to the position illustrated in FIG. 4, wherein they overly the top of chamber 4 just above the burner plate 22, so that the pan containing the foodstuff to be heated may be placed on top of these feet 60, 62, and the fixed foot 64, thereby spacing the bottom of the pan from top wall 16 to permit the escape of hot gases.

If the illustrated heater is to be used for heating a liquid or other material that can be accommodated within cup 70 (FIG. 5), then feet 60, 62 are pivoted to their inoperative positions, as illustrated in FIG. 1. The cup (containing the foodstuff to be heated) is inserted into the top of compartment 4 and is used to press down burner plate 22 against the action of spring 26, until it is retained in its lower position by retainer clip 28. For this purpose, handle 74 of cup 70 would be received within the upper annular recess 76 of the cup, the height of the cup being such that it may be used for pressing down the burner plate 22 until retained by retainer clip 28 before handle 74 is engaged by top wall 58 of the burner housing 2.

When the burner plate 22 has thus been moved to its lower position and retained in that position by clip 28, handle 74 may then be inserted into the lower recess 78 of the cup so that the handle supports the cup with its bottom wall spaced from burner plate 22 while the cup, and its contents, are being heated by the heat produced in the burner chamber 4.

During either of the above-described operations, the two curved side walls 30, 32 of the housing section 2*b* would be pivoted to their open positions as illustrated in FIGS. 1, 3 and 4, so that their feet 36 together with foot 38, provide a 3-point stable support for the burner. Opening the gas container compartment 8 in this manner during operation of the burner also assures good ventilation of this compartment and prevents the possibility of gas accummulation in that chamber which could be a safety hazard.

When the heater is not in use, the side walls 30 and 32 may be closed so as to provide a compact unit for storage or transportation.

While the illustrated heater includes a retainer clip 40 for retaining the side walls 30, 32 in their closed positions, it will be appreciated that other retainer means could be used, for example, over-center springs urging the side walls to their stable open or closed positions. Many other variations, modifications, and applications of the illustrated embodiment of the invention may be made.

What is claimed is:

1. A portable gas heater particularly useful for heating foodstuffs, comprising:

a housing including a first section defining a gas burner compartment including a gas burner, and a second section defining a gas container compartment having a fitting for receiving a gas cylinder;

means for interconnecting the fitting to the gas burner for conduction of gas to the gas burner;

said second section of the housing including a pair of side walls hingedly mounted at one end along vertical axes, such that their opposite ends may be pivoted towards each other to a closed position to close said gas container compartment or to an open position to open said gas container compartment;

the bottom of said pair of side walls, when in their open positions, being engageable with a surface supporting the portable gas heater to provide a stable support therefor during use.

2. The heater according to claim 1, wherein said first and second sections of the housing are in side-by-side relationship.

3. A portable gas heater particularly useful for heating food-stuffs, comprising: a housing including a first section defining a gas burner compartment, and a second section defining a gas container compartment; and a gas burner including a nozzle fixed at the lower end of said gas burner compartment a burner plate overlying said nozzle, and a duct for conducting the combustible gas from the nozzle to the underface of the burner plate; said duct being constituted of a plurality of telescoping tubes to enable the burner plate to be positioned either at the lower end of the gas burner chamber for accommodating a food-containing vessel, or at the upper end of the gas burner chamber to enable the heater also to be used for heating other food-containing vessels supported at the top of the gas burner chamber.

4. The burner according to claim 3, wherein said telescoping tubes include a lower tube fixed to said gas burner nozzle, an upper tube fixed to said burner plate, and at least one intermediate tube interconnecting said lower and upper tubes in telescoping relationship.

5. The heater according to claim 3, wherein said burner plate comprises an annular ring and an inner screen secured thereto.

6. The heater according to claim 3, wherein said burner plate is spring-urged towards the upper end of the gas burner chamber.

7. The heater according to claim 6, further including a retainer clip for releasably retaining the burner plate at the lower end of said gas burner chamber.

8. A portable gas heater, particularly useful for heating foodstuffs, comprising:

a housing having an air inlet and defining a first inner compartment for receiving a gas container having an outlet nozzle controlled by a valve, and a second inner compartment including a gas burner chamber defined by a wall inwardly spaced from said housing to provide an indirect air passage from the air inlet of the housing into the burner chamber, said second inner compartment open at its upper end for supporting a food container while otherwise effectively completely enclosing the flame produced therein during use of the gas burner;

a gas burner located at the bottom of said second inner compartment; and, valve operator means cooperable with the valve nozzle of a gas container when received in said first inner compartment for controlling the flow of gas from the gas container to said burner.

9. The portable gas heater according to claim 8, wherein said gas container compartment and said gas burner compartment are in side-by-side relationship, there being a conduit leading from the top of said gas container compartment to said burner.

10. The portable gas heater according to claim 8, in combination with a food container having a rim engageable with the open upper end of the gas burner compartment for supporting the food container therein, with the bottom of the food container spaced slightly above said burner.

11. The portable burner according to claim 8, wherein said gas container compartment includes a pair of side walls hingedly mounted at one end along vertical axes, such that their opposite ends may be pivoted towards each other to a closed position to close said gas container compartment or to an open position to open said gas container compartment; the bottom of said pair of side walls, when in their open positions, being engageable with a surface supporting the portable gas heater to provide a stable support therefor during use.

12. The burner according to claim 8, wherein said gas burner compartment includes a gas burner chamber defined by a cylindrical wall inwardly spaced from said gas container compartment to provide an air passage therebetween, the upper end of said cylindrical wall being open for the reception of a food-containing vessel to be heated by the gas burner.

13. A portable gas heater particular useful for heating foodstuffs, comprising:

a housing including a first section defining a gas burner compartment, and a second section defining a gas container compartment;

said gas burner compartment including a gas burner chamber defined by a cylindrical wall inwardly spaced from said first sections of the housing to provide an air passage therebetween, and a gas burner disposed at the lower end of said cylindrical wall, the upper end of said cylindrical wall being open for reception of a food-containing vessel to be heated by the gas burner;

said second section of the housing including a pair of sidewalls hingedly mounted at one end along vertical axes, such that their opposite end may be pivoted towards each other to a closed position to close said gas container compartment or to an open position to open said gas container compartment;

the bottom of said pair of side walls, when in their open position, being engagable with a surface supporting the portable gas heater to provide a stable support therefor during use.

14. The heater according to claim 13 wherein said gas burner includes a nozzle fixed at the lower end of said gas burner compartment, a burner plate overlaying said nozzle, and a duct for conducting the combustible gas from the nozzle to the underface of the burner plate.

15. The heater according to claim 14 wherein said duct is constituted of a plurality of telescoping tubes to enable the burner plate to be positioned either at the lower end of the gas burner chamber for accommodating said food-containing vessel, or at the upper end of the gas burner chamber to enable the heater also to be used for heating other food-containing vessels supported at the top of the gas burner chamber.

16. The heater according to claim 15 where said telescoping tubes include a lower tube fixed to said gas burner nozzle, an upper tube fixed to said burner plate, and at least one intermediate tube interconnecting said lower and upper tubes in telescoping relationship.

17. The heater according to claim 15 wherein said burner plate comprises an annular ring and an inner screen secured thereto.

18. The heater according to claim 15 wherein said burner plate is spring-urged towards the upper end of the gas burner chamber.

19. The heater according to claim 18 further including a retainer clip for releasably retaining the burner plate at the lower end of said as burner chamber.

20. The heater according to claim 15 wherein said first section of the housing defining said gas burner compartment includes openings therethrough to permit the entry of air via said air passage between the housing and the cylindrical wall defining the gas burner chamber.

21. A portable gas heater, particularly useful for heating foodstuffs comprising:

a housing defining a gas burner compartment including a gas burner chamber defined by a cylindrical wall inwardly spaced from said housing to provide an air passage therebetween, said housing including an opening thereby permitting indirect entry of air into the gas burner chamber via said air passage, and a gas burner disposed within said cylindrical wall, the upper end of said cylindrical wall being open for reception of a food containing vessel to be heated by the gas burner, and said housing further defining a gas container compartment for receiving a gas container including means for conducting gas from the gas container compartment to said burner.

22. The heater according to claim 21 wherein said gas burner includes a nozzle fixed at the lower end of said gas burner compartment, a burner plate overlying said nozzle, and a duct for conducting the combustible gas from the nozzle to the underface of the burner plate.

23. The heater according to claim 22 wherein said duct is adjustable to enable the burner plate to be positioned either at the lower end of the gas burner chamber for accommodating said food-containing vessel, or at the upper end of the gas burner chamber to enable the heater to be used for heating other food-containing vessels supported at the top of the gas burner chamber.

24. The heater of claim 23 in combination with a food container having a rim engagable with the upper end of the gas burner compartment for supporting the food container within the gas burner chamber with the bottom of the food container spaced in close proximity to said gas burner plate when said gas burner plate is positioned at the lower end of the gas burner chamber.

25. The heater of claim 24 in combination with a food container configured to engage the upper end of the gas burner compartment for supporting the food container at the top of the gas burner compartment with the bottom of the food container spaced in closed proximity to said gas burner plate when said gas burner plate is positioned at the upper end of the gas burner chamber.

26. The heater according to claim 22 wherein said adjustable duct comprises a plurality of telescoping tubes including a lower tube fixed to said gas burner nozzle, an upper tube fixed to said burner plate, and at least one intermediate tube interconnecting said lower and upper tubes in telescoping relationship.

27. The heater according to claim 26 where said burner plate is spring loaded toward the upper end of the gas burner chamber.

28. The heater according to claim 27 further comprising a retainer clip for releasably retaining the burner plate at the lower end of said gas burner chamber.

29. The heater according to claim 21 wherein said housing defining said gas burner compartment includes openings therethrough to permit the entry of air into said air passage between the housing and the cylindrical wall defining the gas burner chamber.

* * * * *